United States Patent [19]

Eliot et al.

[11] 4,193,602

[45] Mar. 18, 1980

[54] BOARD GAME

[75] Inventors: Christopher M. Eliot, 55A, Frogmore St., Abergavenny, Gwent, Wales; Edward B. Taylor, Eastbourne, England

[73] Assignee: Christopher Mark Eliot, Sussex, England

[21] Appl. No.: 906,488

[22] Filed: May 17, 1978

[30] Foreign Application Priority Data

Aug. 5, 1977 [GB] United Kingdom ..... 32971/77
Oct. 19, 1977 [GB] United Kingdom ..... 43480/77

[51] Int. Cl.[2] ..... A63F 3/00
[52] U.S. Cl. ..... 273/236; 273/288
[58] Field of Search ..... 273/272, 236, 273, 267

[56] References Cited

U.S. PATENT DOCUMENTS

| | | | |
|---|---|---|---|
| 2,900,190 | 8/1959 | Pestieau | 273/236 X |
| 2,901,255 | 8/1956 | Sutherland | 273/267 |
| 3,472,514 | 10/1969 | Green | 273/272 |
| 3,565,436 | 2/1971 | Opmeer | 273/265 |
| 3,904,207 | 9/1975 | Gold | 273/272 |
| 3,947,037 | 3/1976 | Hasegawa | 273/264 |
| 3,964,749 | 6/1976 | Wadsworth | 273/157 R |
| 4,047,719 | 9/1977 | Sajkovic | 273/272 |

FOREIGN PATENT DOCUMENTS

| | | | |
|---|---|---|---|
| 2259632 | 8/1975 | France | 273/273 |
| 2279436 | 2/1976 | France | 273/258 |
| 407635 | 3/1934 | United Kingdom | 273/265 |
| 885340 | 12/1961 | United Kingdom | 273/272 |
| 1148172 | 4/1969 | United Kingdom | 273/236 |
| 1469225 | 4/1977 | United Kingdom | 273/267 |

*Primary Examiner*—Richard C. Pinkham
*Assistant Examiner*—Scott L. Brown
*Attorney, Agent, or Firm*—Sigalos & Levine

[57] ABSTRACT

The invention relates to board game apparatus which comprises a surface which is provided with a playing area having an array of playing positions arranged regularly with respect to one another. At least some of the playing positions have one of a number of surface characteristics inscribed thereon. A plurality of playing pieces are used to play the game, each playing piece having one of a different number of shapes each arranged so as to cover, substantially exactly, a different whole number of playing positions on the playing surface.

7 Claims, 1 Drawing Figure

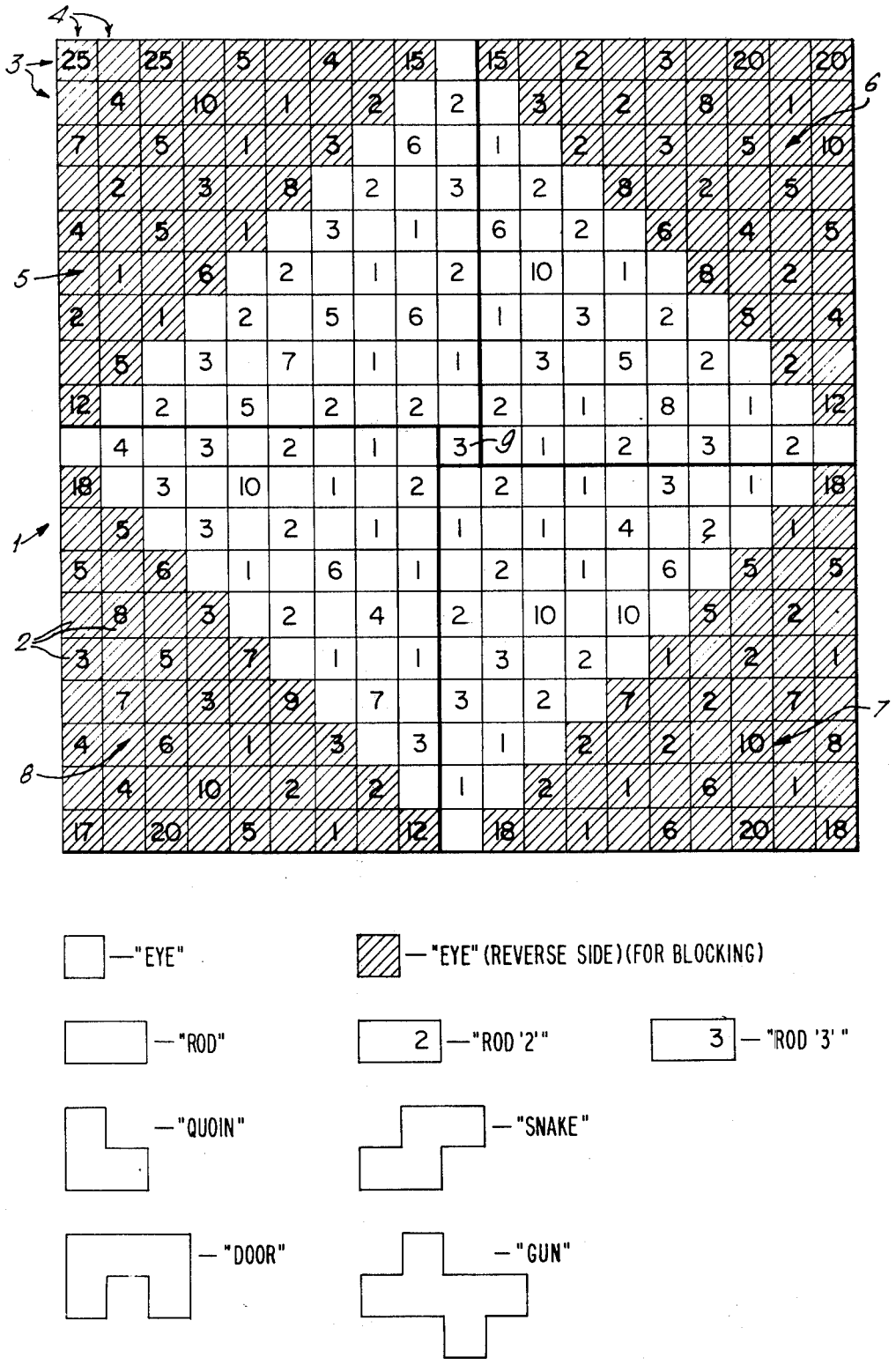
"EYE"
"EYE" (REVERSE SIDE) (FOR BLOCKING)
"ROD"
"ROD '2'"
"ROD '3'"
"QUOIN"
"SNAKE"
"DOOR"
"GUN"

BOARD GAME

The invention relates to a board game to be played by two or more players.

Existing board games generally fall into one of three broad categories. Firstly, there are those games which are of the "Monopoly" (Registered Trade Mark) type, that is to say those which include a marked board and a number of counters which are moved around the board, usually in response to a number thrown, for example, on dice. Secondly, there are those "tactical" games such as chess, draughts, checkers etc. Thirdly, there are those games such as "Scrabble" (Registered Trade Mark) where counters have to placed in particular orders in order to score points aggregated from the points shown on the counters.

According to the present invention, apparatus for playing a board game comprises a surface provided with a playing area having an array of playing positions arranged regularly with respect to one another, at least some of the playing positions having one of a number of surface characteristics inscribed thereon; and a plurality of playing pieces, each playing piece having one of a different number of shapes each arranged so as to cover, substantially exactly, a different whole number of playing positions on the playing surface.

Preferably, the playing positions are arranged in a series of rows and columns and alternate playing positions in each row and column have a number inscribed thereon. The playing surface may be square and the playing positions made up of smaller squares. In order to provide a central, starting position it is advantageous if each row and column contains an odd number of playing positions.

Alternatively, a hexagonal array of playing positions could be provided, each playing position having a hexagonal outline and the playing positions nesting together in bee-hive cell fashion to cover completely the playing surface. Likewise, the playing surface might comprise a triangular array of triangular playing positions. The playing pieces may be arranged in different shapes each comprising one or more portions each substantially the same area as the area of each of the individual playing positions. In the case of a square board with square playing positions the playing pieces would each be made up of a number of squares and similarly with a hexagonal, triangular or other shape board. Whilst the surface characteristics are preferably numbers it may be possible to allocate different playing positions different colours or other characteristics.

To play the game the playing pieces are divided between the players and they play in turn, positioning their pieces over the playing positions so that each playing piece covers the playing position adjacent an already-covered playing position in the same row or column (when played on a square or rectangular board as is preferred). The playing pieces are preferably not allowed to be positioned to cover only a diagonally adjacent playing position and each player scores in accordance with numbers on the playing positions which he or she covers with his or her playing pieces and the object of the game is to score the highest total when all the playing pieces have been played.

Preferably, each of the playing pieces has two playing faces, either of which can be placed on the playing surface. The two faces of each playing piece may be different in order to distinguish them, and when one of the faces is played that piece can be used to block the opponent's next move, preventing him from playing off that particular playing piece for one or more moves. Advantageously, the playing pieces comprise a number of sets, the individual playing pieces of a given set having the same shape as the shape of the playing pieces in the other sets. Preferably, the shape of each of the playing pieces in each set is different so that each piece in a set covers a differing number of playing positions on the playing surface and in a different configuration.

The playing area may be divided into an inner and an outer arena, by means of the playing positions having a different surface characteristic such as colour to distinguish the two arenas. It is a further advantage if the numerals on the playing positions in given sectors of the playing area total the same amount. For example, with a square or rectangular board the playing positions in each quarter of the playing area would be arranged to total the same. Preferably, the numbers within each quarter of the inner arena also total the same amount and the game can be made more interesting if the numbers are not arranged on the playing positions symmetrically, thus ensuring that each quarter of the playing area has a different layout although the same overall total. When the total number of playing positions is odd the central playing position can be considered as being included in all or none of the four quarters for the purpose of the total of the numbers in each quarter.

As an alternative it is envisaged that the arrangement of numbered playing positions on the board could be varied from the above alternate one so that, for example, there might be groups of playing positions having numbers, interspaced by groups of playing positions without numbers, whereby a competitor would have to reach one of these groups of numbered playing positions by non-scoring moves before he could score at one of these groups of numbered playing positions. Of course, every playing position on the playing surface could be numbered, but this we have found tends to make the game less interesting as there is less skill involved in selecting high scoring positions for the playing pieces. Furthermore, with some of the playing pieces a very large number of numbers can have to be added together thus making the game more complicated for younger players.

Instead of numbers, playing positions may be coloured and the object of the game in that case might be to cover and thereby capture certain numbers of certain colours. Each playing position captured might be represented by a small coloured counter so that by capturing certain numbers of certain colours it would be possible to build up, separately from the board, a winning pattern on a separate coloured chart for example; that is to say every time a piece covers say a blue square then a blue counter may be placed on the coloured chart at a suitable position and the first person to complete the colour chart would be the winner.

Alternatively, the playing positions might include representations of animals, fruit etc. This would be useful for a game for very young children where the object might be to build up a pattern or scene with the playing positions captured, the pattern or scene being built up with cards or counters corresponding to the positions captured.

One example of the apparatus of the present invention will now be described with reference to the accompanying drawing which shows a playing surface and one of each of a number of different sets of playing pieces for use in the game.

The playing surface 1 is preferably provided on a flat square board as is well known and comprises 361 square playing positions 2 arranged in 19 rows and columns 3 and 4 respectively. Alternate squares in each row and column contain a number, so that the numbered playing positions are diagonally adjacent one another. The board can be considered in four quarters 5, 6, 7 and 8 each containing nine rows or columns and ten columns or rows respectively to make a total of 90 square playing positions. The centre playing square 9 is excluded.

Additionally, the playing area has a generally square inner arena and four separate parts of an outer arena. The inner arena is distinguished from the outer arena by the square playing positions having different surface characteristics, such as colour as shown.

Each quarter of the inner arena includes playing positions the numbers on which total the same amount and the same is true of the quarters 5, 6, 7 and 8 of the whole playing area.

The playing pieces are composed of six sets each of six different shapes, the shapes being shown in the drawing with the names by which they are preferably known. The playing pieces or shapes are plain on one side and ribbed on the other, although, of course, the two sides may be distinguished in other ways.

Two of each set of playing pieces of the same shape may be completely blank on both faces, two further sets may have a first number provided on each face and the final two sets may have a second number provided on each face. The reason for this will become apparent as the playing of the game is described.

The example shown is suitable for playing by any number from two to six players although, this will change, depending on the number of playing positions and the number of playing pieces which are provided in any given case.

Prior to the start of the game each player receives 18 pieces, preferably of a single colour to distinguish them from his opponents pieces, that is three of each shape. One of each of the pieces of each shape is unmarked, one is marked with a "2" and one is marked with a "3." The commencing playing can be chosen by the toss of a coin or by one player concealing an "Eye" in one or other or his hands. A correct guess means that the guessing player starts.

The commencing player selects any one of his 18 pieces and places it, white side up, on the playing area, covering the centre square 9. The players continue to play in turn, placing each shape adjacent to any shape already played, the placings must be made adjacent to, but not diagonally adjacent to, any shape already played.

The player normally scores the total of any numbers on the playing positions which he covers by the shape which he plays, but in addition, the shapes with "2" or "3" printed on them are able to score more as, when the "2" or "3" covers a numbered square on the playing area that number is multiplied by the "2" or "3" respectively. Any other number or numbers covered by the same shape are added to this total at face value. An unmarked shape therefore scores all its numbers at face value.

Each player is constrained to play within the inner arena until he has scored 75 points. He can then move into the outer arena where it can be seen that, in general, the numbers on the playing squares are higher than those of the squares within the inner arena.

At any time during the game a player may use his turn to block his opponent's next move. He cannot prevent his opponent from playing altogether but, he can prevent his opponent from playing off the piece which he himself has just played. He achieves this by placing his shape or playing piece ribbed side up on the playing area. His opponent may not, for one turn only, place one of his shapes adjacent to the blocking shape. Blocking is obviously not permitted at the beginning of the game as the first player would win automatically. The playing of a blocking shape scores for the player in the same way as shapes placed white side up and includes the doubling or tripling of a number covered with the "2" or "3" on the shape. However, in order to offset the advantage of the block the player's score is halved. Any odd number score is halved by taking off the additional ½ score after halving.

The players continue to play in turn until they have played all their pieces and the winner is the player with the highest score. The scoring is done openly so that the players know each others total at any time during the game and at all times the players should be permitted to have sight of their opponent's remaining shapes.

The playing shape may be formed of wood, plastics or any other suitable material appropriately coloured or profiled.

To play the game with four players in pairs each pair receives 18 pieces as in the game for two players, but these are divided between the players in each pair so that the first player receives 1 Gun unmarked, 1 Gun marked "2," 1 Door marked "3," 1 Snake unmarked, 1 Snake marked "2," 1 Quoin marked "3," 1 Rod marked "2," 1 Rod unmarked, and 1 Eye marked "3." His partner receives the remaining shapes. Additionally, there should be no consulting between pairs during the game and the blocking shape remains in force for one turn only so that the partner of the player who first blocks may play onto the blocking shape. The partners should sit opposite one another.

In games for three, four (playing individually), five and six players a blocking move remains in force until the blocking player receives his or her next turn. In the game for four players playing individually the pieces are the same as in the game for four players playing in pairs. In the game for three players each player receives 12 pieces, that is two of each shape and the shapes count as unmarked, that is to say there is no doubling or tripling of playing position numbers. In the game for five or six players each player receives one of each shape and again the shapes count as unmarked.

It can be seen from the drawing that each of the differently shaped pieces has an area corresponding to a number of squares between 1 and 6. This fact can be used to enable a simpler game to be played using a die. The die is thrown by each player in turn who then has to play one of his pieces having the number of squares shown by the number on the die. For young children this eliminates much of the skill of the game making it easier to play, but retaining the essential characteristics and enjoyment.

It will be appreciated that the game can be played at many levels and that the skill of a player will increase as he plays more often as he becomes conversant with various ploys etc. The game is restricted to the inner arena initially in order to prevent the players reaching the higher numbers in the corners too quickly. Also, it increases the skill required to play the game at its highest levels because whilst it is relatively easy to score 75 in the inner arena using ones shapes marked "2" and "3," scores in the outer arena will then be limited if the player has no marked shapes left and has to use the unmarked shapes.

We claim:

1. Apparatus for playing a board game, said apparatus comprising:

a. a board, b. said board having a surface provided with a playing area having an array of playing positions, c. said positions being arranged in a series of rows and columns, and at least some of said playing positions having a number inscribed thereon, d. a number of sets of playing pieces, e. each of said playing pieces having one of a number of different shapes, f. each of said shapes being arranged so as to cover, substantially exactly, a whole number of said playing positions on said playing area, g. each of said different shapes covering a different number of said playing positions, and each of said sets including at least one piece of each of said different shapes, h. and said playing area defining an inner and an outer arena, said inner and outer arenas being distinguishable one from the other, and i. and said numbers on said playing positions in said outer arena comprising a total greater than those on said playing positions in said inner arena.

2. Apparatus according to claim 1 wherein said numbers are inscribed only on alternate playing positions in each of said rows and columns.

3. Apparatus according to claim 1 wherein said playing surface is square and wherein said playing positions are also square.

4. Apparatus according to any of claims 1, 2 or 3 wherein each of said rows and columns contains an odd number of said playing positions.

5. Apparatus according to claim 1, wherein each of said playing pieces has two distinguishable playing faces.

6. Apparatus according to claims 1 or 5 wherein each set of said playing pieces comprises a plurality of pieces of each of said different shapes.

7. Apparatus according to claim 6 wherein, in each of said sets, one or more of said pieces of each of said different shapes includes a number thereon.

* * * * *